US005918343A

United States Patent [19]

Young

[11] Patent Number: 5,918,343

[45] Date of Patent: Jul. 6, 1999

[54] COMBINATION BUCKET AND WRINGER

[76] Inventor: Ronald Scot Young, 710 S. 9th St., St. Joseph, Mo. 64502

[21] Appl. No.: 09/141,987

[22] Filed: Aug. 28, 1998

[51] Int. Cl.[6] ..... A47L 13/60

[52] U.S. Cl. ..... 15/262; 15/260; 15/264; 100/132

[58] Field of Search ..... 15/260–264; 68/239, 68/244, 272; 100/121, 132, 134, 135

[56] References Cited

U.S. PATENT DOCUMENTS

| | | | |
|---|---|---|---|
| 878,660 | 2/1908 | McDonald | 15/262 |
| 2,497,468 | 2/1950 | Poirier et al. | 15/262 |
| 3,383,732 | 5/1968 | James et al. | 15/260 |
| 4,735,332 | 4/1988 | Thumser | 220/735 |
| 4,878,264 | 11/1989 | Young | 15/264 |
| 4,888,847 | 12/1989 | Montijo | 15/263 |
| 5,175,904 | 1/1993 | Pagani | 15/262 |
| 5,333,353 | 8/1994 | Taylor | 15/264 |
| 5,349,720 | 9/1994 | Primeau | 15/262 |
| 5,414,892 | 5/1995 | Clark, Jr. | 15/263 |

FOREIGN PATENT DOCUMENTS

| | | | |
|---|---|---|---|
| 0311360 | 4/1989 | European Pat. Off. . | |
| 1503753 | 5/1969 | Germany | 15/263 |
| 2905319 | 8/1980 | Germany | 15/260 |
| 3879606T2 | 10/1993 | Germany . | |
| 450798 | 7/1936 | United Kingdom . | |
| 2239388 | 7/1991 | United Kingdom . | |

*Primary Examiner*—Mark Spisich
*Attorney, Agent, or Firm*—Wm. Bruce Day

[57] ABSTRACT

A combination mop bucket and wringer unit uses a thin walled plastic mop bucket with a cap-like wringer body which fits securely over the top of the bucket to form a unitary structure. The wringer body adds rigidity to the thin walled mop bucket so that it is able to resist the downward force of the wringer handle lever without buckling. The bucket may be lifted or otherwise moved using only the handle lever. The combination or unitary structure lifting a wringer, a bucket, a mop handle and a mop. Use in small cleaning areas where the combination bucket and wringer is carried from area to area is ideal for this device.

8 Claims, 2 Drawing Sheets

COMBINATION BUCKET AND WRINGER

FIELD OF THE INVENTION

This invention relates to mop buckets such as a mop bucket in which cleaning liquid is used to rinse out a mop and particularly to mop buckets and wringers which are used to squeeze the water out of a mop.

BACKGROUND OF THE INVENTION

The usual mop bucket and wringer consists of a bucket having a bottom with wheels mounted to it so that it can roll across a floor. A wringer unit is suspended into the top of the bucket and is commonly held therein by the use of rear and side hangers or hooks which fit over the rim of the bucket and hang the wringer unit in the top of the bucket. The hooks or hangers are often several inches long and exert stress on relatively small areas to create stress points on the bucket. Therefore, the bucket must be of relatively sturdy and heavy duty construction to resist the bending forces applied thereto by the wringer mounted on the bucket sidewalls. Moreover, the wringer is usually suspended within the bucket with the result that the wringer can be easily lifted out of the bucket. This is not a problem when the user intends to remove the wringer from the bucket, but all too often the wringer inadvertently separates from the bucket, as when moving the bucket and can spill mop water on the floor.

According to the present invention, there is provided a combination mop bucket and wringer which uses a bucket of particularly thin-walled, generally a plastic, construction material, which by itself would be flimsy and probably unsuitable for general use as a mop bucket. However, a wringer is also provided which includes a cap-like body which fits over a substantial portion of the top of the mop bucket and is secured thereto. The mating configuration of the mop bucket and wringer provides a secure connection whereby the wringer cannot be inadvertently lifted or even removed from the mop bucket, and the wringer provides a cap or top which secures and strengthens the combined structure as a whole to resist buckling or bending of the bucket sidewalls. Additionally, the combined unit can be lifted by the wringer handle lever without concern for the wringer lifting off the bucket. The connection between the mop bucket and wringer body is by interlocking the bucket sidewall edge and the wringer downward edge so that once connected, they cannot be readily disconnected except through the use of tools.

OBJECTS OF THE INVENTION

The objects of the present invention are: To provide a combined mop bucket and wringer which forms a unitary whole structure; to provide such a combined mop bucket and wringer which uses a thin-walled mop bucket of relatively low cost construction which is strengthened by a cap-like wringer body; to provide such a combined mop bucket and wringer which can be grasped by the wringer handle and lifted or moved from area to area without disconnection of the wringer from the mop bucket; to provide such a combined mop bucket and wringer which is low in cost yet strong and sturdy in construction, is economical to produce, effective in use, and well suited for the purposes for which it is intended.

DESCRIPTION OF THE PREFERRED AND ALTERNATE EMBODIMENTS

As required, detailed embodiments follow and disclose particular forms of the invention as examples of how the invention may be configured. However, it is foreseen that other designs and configurations may be formed according to the invention without departing from the scope of the invention.

Figure 1:
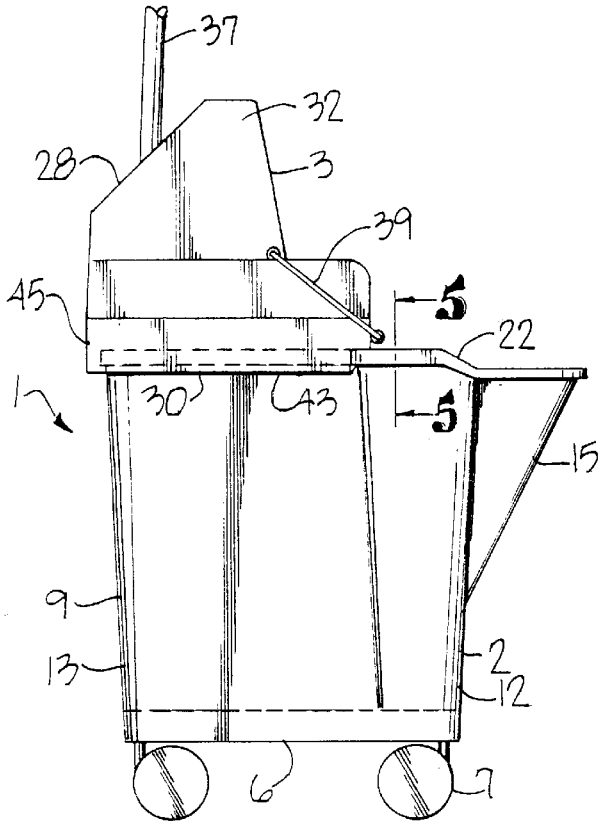
FIG. 1 is a side elevational view of a combined mop bucket and wringer unit.

The reference numeral 1, FIG. 1, refers to a combined mop bucket and wringer unit according to the present invention. The combined unit 1 generally consists of a mop bucket 2 and wringer 3.

Figure 3:
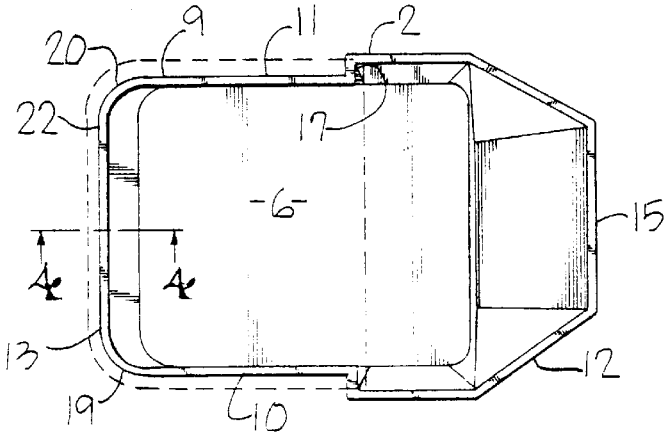
FIG. 3 is a top plan view of the mop bucket with the wringer removed.
Figure 4:
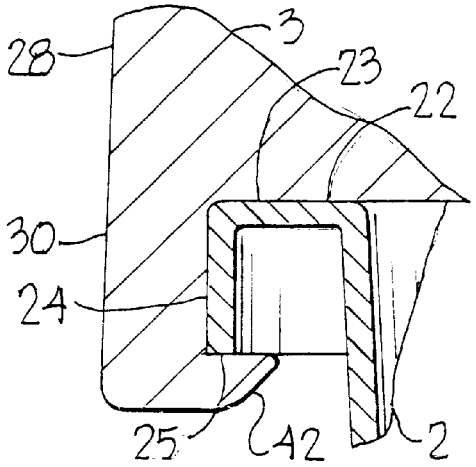
FIG. 4 is a fragmentary sectional view taken along lines 4—4, FIG. 3.
Figure 5:
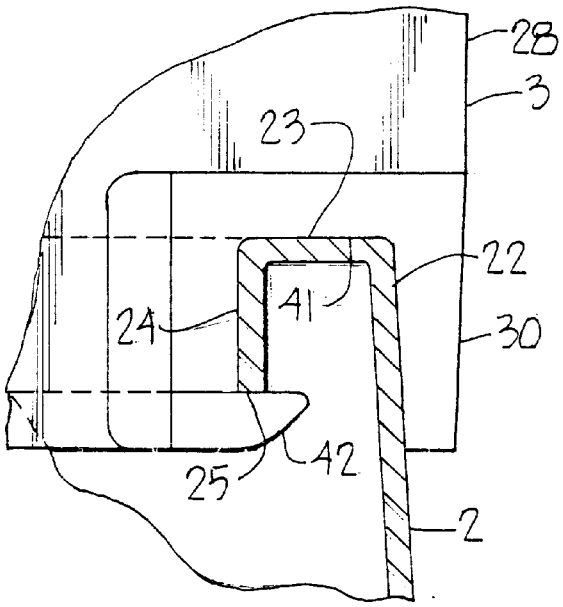
FIG. 5 is a fragmentary sectional view taken along lines 5—5, FIG. 1.

The mop bucket 2 is of thin-walled construction and consists of a bottom 6 with wheels 7 mounted thereto for movement over the floor surface. The mop bucket is formed by a surrounding sidewall 9 which includes opposite walls 10 and 11 and front and rear walls 12 and 13. A pour spout 15 is formed in the front wall 12 for ease of pouring mop water from the bucket 2. The sidewalls 9 are generally rectangularly arranged, FIG. 3, with the pour spout 15 projecting forwardly. Mid-side support walls form vertical steps 17 in the sidewalls. The steps 17 provide strength to the walls 10 and 11 to inhibit buckling or undue flexibility. Forward of the step 17, the bucket 2 is wider than to the rear of the step 17, see FIG. 3. The steps 17 taper downwardly to join smoothly with the sidewalls 10 and 11 approaching the bucket bottom 6. The rear corners 19 and 20, FIG. 3, of the bucket 2 are radiused for strength.

The bucket 2 has an inverted U-shaped rim 22 formed to provide strength and prevent buckling. The rim 22 includes a horizontal section 23 and a downwardly extending portion 24 terminating at 25.

The bucket 2 is of a synthetic plastic material, plastic including polyvinyl, polyurethane or other synthetic resinous materials. The wall thickness is unusually thin for the capacity of the bucket. For example, the preferred wall thickness is 0.068" within a range of plus or minus 0.010. Other competitive buckets are considerably thicker, for example, in the range of 0.140 to 0.185 for normal commercially available buckets. Heavy duty buckets made by certain manufacturers including the Rubbermaid Company are up to 0.260 or 0.370 inch thickness.

Figure 2:
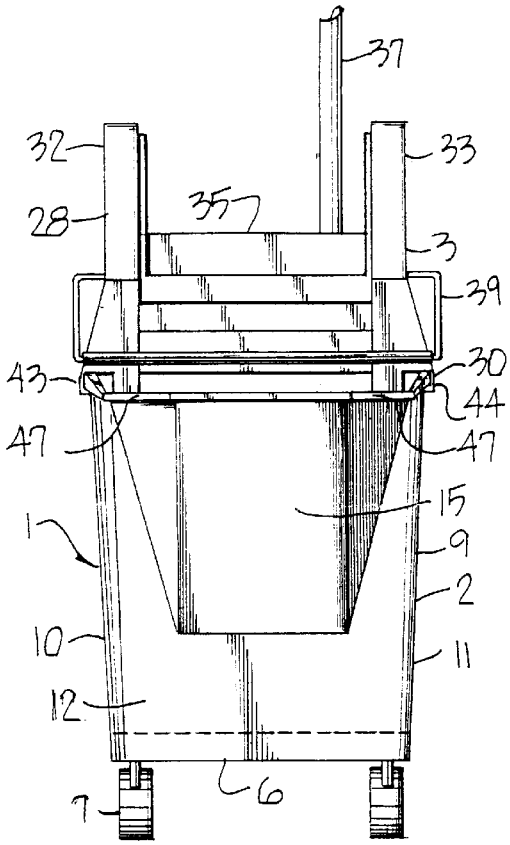
FIG. 2 is a front elevational view of the combined mop bucket and wringer unit.

The wringer 3 fits atop the bucket 2 and is preferably composed of a material of like composition and like thickness to the bucket 2. In the illustrated example, the wringer 3 consists of a cap-like body 28 with a depending peripheral skirt 30. The body 28 includes upstanding walls 32 and 33 which support wringer presses 35, FIG. 2, operably connected to a wringer handle lever 37. A handle or bail 39 is attached to the body 28 for lifting the combined mop bucket and wringer unit 1.

The skirt 30 includes a recess 41 sized for a snug interference fit receipt of the rim 22. The skirt 30 includes a overhanging catch or finger 42 which projects inwardly and being of flexible material, is intended to snap over the end 25 of the downwardly extending section 24 of the rim 22.

The skirt 30 is continuous throughout opposite sides 43 and 44 and back 45 of the wringer 3 and includes spaced skirt tabs 47 which extend downwardly and fit over the rim at the step 17. By connection at these areas, the area of connection between the wringer 3 and mop bucket 2 is substantially continuous. The over center engagement finger 42 provides secure connection between the mop bucket 2 and wringer 3. Once snapped on, the wringer 3 is substantially non-removable from the bucket 2 except through use of a prying tool such as a screw driver or a grasping tools such as a pair of pliers which could be used to bend back the finger 42 so that the wringer 3 can be pried off the mop bucket 2.

The mop bucket and wringer unit 1, being of thin-walled construction separately, is securely joined as a unit which prevents buckling or undue distortion of the relatively thin-walled material. In this manner, a lighter weight combination mop bucket and wringer unit 1 can be constructed conserving materials and bringing a lesser price in the marketplace.

It is to be understood that the disclosed embodiments are illustrative in nature and the invention is not to be limited to any one or more embodiments except as set forth in the following claims.

What is claimed and desired to be secured by Letters Patent is as follows:

1. A combination mop bucket and wringer unit comprising:

a) a mop bucket having a bottom, surrounding sidewalls with an upper lip and a front pour spout, the bucket having wheels for movement over a floor surface;

b) the bucket having at least the sidewalls thereof of thin-wall configuration and susceptible to bending and buckling upon exertion of downward force;

c) a wringer including a cap-like body fitting over a substantial portion of the sidewalls upper lip, an internal roller arrangement for squeezing water from a mop and a wringer handle lever operably connected to said roller arrangement; and d) connection means extending between said bucket sidewalls upper lip and said wringer body, said connection means securely engaging said wringer with said bucket and preventing lift off of said wringer from said bucket and connected to said sidewalls upper lip over a sufficient area thereof to substantially reduce bending and buckling of said sidewalls upon downward force applied to the wringer handle lever;

e) said sidewalls upper lip being generally in the shape of an inverted "U", and said wringer body having a peripheral skirt which fits over said sidewalls upper lip with a recess therearound sized to frictionally fit said sidewalls upper lip.

2. The mop bucket and wringer unit set forth in claim 1 wherein said recess in said peripheral skirt has an inwardly extending flange for snap fitting snugly over said sidewalls upper lip.

3. The mop bucket and wringer unit set forth in claim 1 wherein said bucket sidewalls are of plastic material and in the range of 0.058 to 0.078 inch thickness.

4. The mop bucket and wringer unit set forth in claim 1 wherein said wringer body is of plastic material and in the range of 0.058 to 0.078 inch thickness.

5. The mop bucket and wringer unit set forth in claim 1 wherein said bucket sidewalls include opposite inner walls dividing said bucket into front and rear portions, said wringer being mounted on said rear portion.

6. A combination mop bucket and wringer unit comprising:

a) a mop bucket having a bottom, surrounding sidewalls with an upper lip and a front pour spout, the bucket having wheels for movement over a floor surface; the upper lip including an inverted "U" shaped rim;

b) the bucket having at least the sidewalls thereof of thin-wall configuration and susceptible to bending and buckling upon exertion of downward force;

c) a wringer including a cap-like body fitting over a substantial portion of the sidewalls upper lip, an internal roller arrangement for squeezing water from a mop and a wringer handle lever operably connected to said roller arrangement, the wringer body having a surrounding skirt having a recess therein sized for snug receipt and interference fit with said bucket rim; and said bucket rim being snugly received with said bucket skirt recess with an interference fit therebetween, and including a flexible catch which is engaged against the rim and prevents inadvertent disconnection of said wringer from said bucket, whereby the bucket and wringer are connected to substantially reduce bending and buckling of said bucket sidewalls upon downward force applied to the wringer handle lever.

7. A combination mop bucket and wringer unit comprising:

a) a mop bucket having a bottom, surrounding sidewalls with an upper lip and a front pour spout, the bucket having wheels for movement over a floor surface;

b) the bucket having at least the sidewalls thereof of thin-wall configuration and susceptible to bending and buckling upon exertion of downward force;

c) a wringer including a cap like body engaging a substantial peripheral portion of the sidewalls upper lip, and having an internal compression arrangement for squeezing water from a mop and a wringer handle lever operably connected to said compression arrangement; and connection means extending between said bucket sidewalls upper lip and said wringer body, said connection means securely mounting said wringer atop said bucket over a sufficient area of the sidewalls upper lip to substantially reduce bending and buckling of the sidewalls upon downward force applied to the wringer handle lever and enabling said bucket to be lifted with said wringer.

8. A combination mop bucket and wringer unit comprising;

a) a mop bucket having a bottom, surrounding sidewalls with an upper lip and a front pour spout, the bucket having wheels for movement over a floor surface;

b) the bucket having at least the sidewalls thereof of thin walled configuration and susceptible to bending and buckling upon exertion of downward force;

c) a wringer including a cap like body engaging a substantial peripheral portion of the sidewalls upper lip, and having an internal compression arrangement for squeezing water from a mop and a wringer handle lever operably connected to said compression arrangement, and d) a connector structure extending between said bucket sidewalls upper lip and said wringer body, said connector structure mounting said wringer atop bucket in engagement with a sufficient portion of the sidewalls upper lip to substantially reduce bending and buckling of the sidewalls upon downward force applied to the wringer handle lever and enabling said bucket to be lifted with said wringer.

* * * * *